United States Patent [19]

Ninomiya

[11] 4,373,649

[45] Feb. 15, 1983

[54] WAISTLINE SUPPORTABLE DISPENSER FOR MARTIAL ARTS "SHURIKENS" THROWING STARS

[76] Inventor: Joko Ninomiya, 4534 E. Colfax Ave., Denver, Colo. 80220

[21] Appl. No.: 297,727

[22] Filed: Aug. 31, 1981

[51] Int. Cl.[3] ..... A41F 9/00

[52] U.S. Cl. ..... 224/163; 224/270; 30/339

[58] Field of Search ..... 224/163, 196, 242, 255, 224/256, 268, 270, 271; 30/339; 248/309 A

[56] References Cited

U.S. PATENT DOCUMENTS 2,578,237 12/1951 Geistweit ..... 224/270

3,823,421 7/1974 Collins ..... 224/163 X

*Primary Examiner*—Steven M. Pollard

*Attorney, Agent, or Firm*—George R. Nimmer

[57] ABSTRACT

A waistline supportable dispenser for a plurality of "shuriken" i.e. an Oriental term denoting martial arts throwing stars. Disclosed herein are novel "shuriken" having elliptical central openings and having a front-face that is preferably dually recessed at the terminii of the elliptical opening minor-axis. The dispenser for such novel "shuriken" comprises: a rack member having support means to permit removable attachment as belt buckle or otherwise at waistline apparel level; a horizontal peg extending rigidly forwardly of the rack member upright frontal-side, the "shurikens" rotatably surrounding the peg trail-length; and spring means yieldably urging the leadmost "shuriken" against the peg cross-sectionally ellipsoid lead-length, whereby the "shurikens" can be individually dispensed by counter-rotation until its central opening major-axis becomes parallel to the broadest-extent of the peg lead-length.

8 Claims, 7 Drawing Figures

WAISTLINE SUPPORTABLE DISPENSER FOR MARTIAL ARTS "SHURIKENS" THROWING STARS

Drawing FIG. 1 is a frontal elevational view of typical prior art "shuriken" i.e. an Oriental term denoting martial arts throwing stars. The "shuriken" "S" of FIG. 1 is of typical prior art structure comprising a pair of parallel and generally planar faces including a front-face "SF" and a geometrically similar rear-face (not shown), both faces being intersected by central-axis "CA". Radiating from central-axis "CA" and at equal angular intervals are "shuriken" points "SP", eight such points "SP" being depicted in FIG. 1. The thin uniplanar "shuriken", which is usually made of durable metal, including at sharpened points "SP", is normally provide with a circular central opening "CC" concentrically surrounding central-axis "CA". Ancillary to certain martial arts maneuvers, "shuriken" are manually thrown toward assigned targets such that one of their sharp points become firmly stuck into the target.

Appropriate for advanced students of the martial arts, a plurality of "shuriken" are to be manually thrown in very rapid succession toward assigned targets. However, this intended task is rendered unusually difficult because the student must perform other hand maneuvers at substantially the same time.

It is accordingly the general objective of the present invention to provide a waistline supportable dispenser for a plurality of "shuriken" whereby the martial arts student can manually throw them in rapid succession toward assigned targets without interfering with interim body maneuvers not directly related to "shuriken" throwing. Ancillary general objectives include: dispensers which are fast and reliable in operation, which do not encumber the student's overall repertory performance, which might ornamentally and functionally adorn the user, and which might be readily employed as the buckle for the user's apparel belt.

With the above and other objects and advantages in view, which will become more apparent as this description proceeds, the waistline supportable dispenser of the present invention generally comprises: each of the "shuriken" to be dispensed being provided with an elliptical central opening rather than with the circular central opening of the prior art; a rack member having an upright frontal-side and having support means permitting removable attachment to the user's wearing apparel substantially at waistline height; a horizontal peg extending forwardly from the rack member frontal-side and including a trail-length and also a lead-length more remote from the rack frontal-side, each "shuriken" being freely rotatable about the peg trail-length, though not rotatable about the peg ellipsoid lead-length which has its broadest-extend dimensionally intermediate the minor-axis and major-axis of the "shuriken" elliptical opening; and spring means forwardly bearing from the rack member to the trailmost "shuriken" whereby they are yieldably urged against the peg lead-length in a condition wherein they can be individually dipensed only by counter-rotation of the leadmost "shuriken" until the elliptical opening major-axis becomes parallel to the broadest-extent of the peg enlarged lead-length.

In the drawing, wherein like characters refer to like parts in the several views, and in which.

Figure 2:
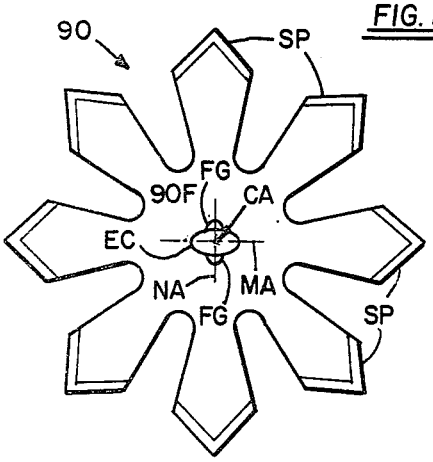
FIG. 2 is a front elevational view similar to FIG. 1 depicting the "shuriken" of the present invention provided with an elliptical central opening and dual recesses at the front-face at the continuations of the elliptical opening minor-axis.
Figure 6:
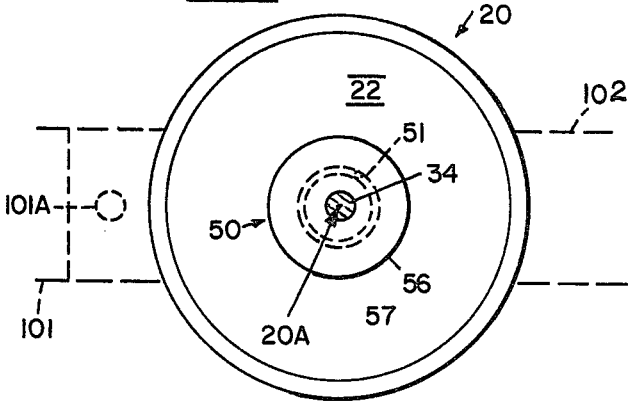
FIG. 6 is a sectional elevational view taken along line 6—6 of FIG. 4.
Figure 3:
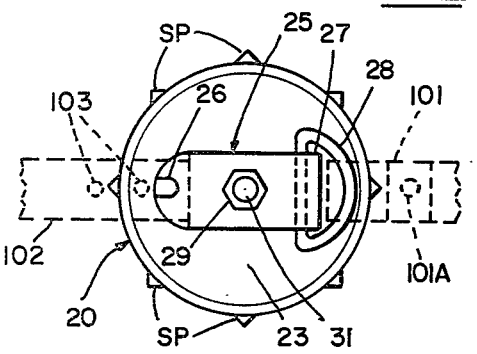
FIG. 3 is a rearward elevational view of the preferred embodiment of the waistline supportable dispenser of the present invention.
Figure 5:
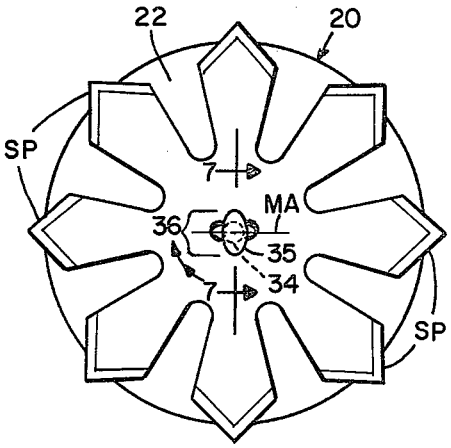
FIG. 5 is a front side elevational view of the preferred embodiment.
Figure 4:
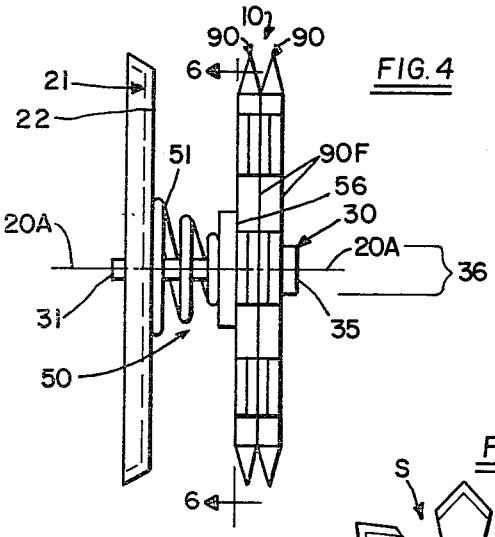
FIG. 4 is a left side elevational view of the FIG. 3 embodiment including "shurikens" of FIG. 2 in side elevation, the right side elevational view (not shown) being a mirror image.
Figure 7:
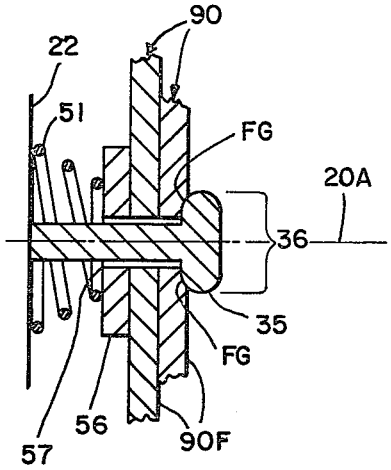
FIG. 7 is a detail sectional view taken along line 7—7 of FIG. 5.
Figure 1:
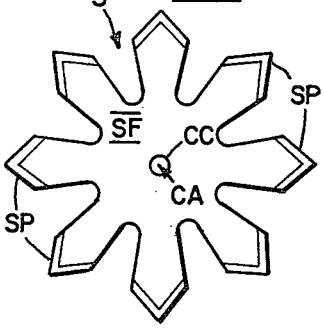
FIG. 1 (PRIOR ART)
FIG. 1 is a front elevational view of a prior art "shuriken" structure including circular central opening, the rear elevational view (not shown) being a mirror image thereof.

Turning initially to FIG. 2, which depicts an elliptically central open "shuriken" 90, required for the waistline supportable dispenser (e.g. 10) of the present invention. "Shurikens" 90 are identical to the prior art structure "S" of FIG. 1 at central-axis "CA", at the rear-face, at radiating points "SP", and at side elevation. However, instead of circular central opening "CC", "shuriken" 90 is provided with an elliptical central opening having major axis "MA" perpendicularly intersecting ellipse minor-axis "NA" at central-axis "CA", "CA" being perpendicular to said axes "MA" and "NA". Dimensionally, ellipse major-axis "MA" is about twice that of ellipse minor-axis "NA". For reasons to be amplified later, dispenser peg 30 has a trail-length 34 wherein its largest cross-sectional dimension does not exceed that for ellipse minor-axis "NA" whereby each "shuriken" is rotatable about peg trail-length 34. In this vein, and as indicated in FIG. 5, the cross-sectional shape of peg trail-length might be circular (e.g. 34). Dispenser peg 30 also has a lead-length 35 including a cross-sectionally ellipsoid portion wherein its broadest-extent 36 is dimensionally intermediate the major-axis ("MA") and minor-axis ("NA") dimensions of "shuriken" elliptical opening "EC". In this vein, and as indicated in FIGS. 2 and 7, "shuriken" front-face 90F is preferably provided with dual recesses "FG" at the two terminii of minor-axis "NA".

As seen in FIGS. 3–7, the waistline supportable dispenser (e.g. 10) generally comprises: a rack member (e.g. 20) having an upright frontal-face 22 and having support means (e.g. 25–28) to permit removable attachment to the user's wearing apparel; a horizontal peg 30 extending forwardly from rack frontal-side 22; a plurality of elliptically centrally open "shuriken" (e.g. 90) rotatably surrounding the peg trail-length; and spring means (e.g. 50) urging the "shuriken" against the peg lead-length whereby the "shuriken" can be individually dispensed only by counter-rotation until opening major-axis "MA" becomes parallel to the broadest-extent 36 of peg lead-length 35.

The preferred embodiment (10) waistline supportable dispenser utilizes an upright circular metallic plate 21 within rack member 20, plate 21 having horizontally extending central-axis 20A. Plate 21 is formed so as to have an upright planar frontal-side 22 and a slightly concave rear-side 23. Peg 30 is rigidly attached to a central portion of rack plate 21 and extends horizontally along central-axis 20A forwardly from frontal-side 22.

In this vein, a metallic peg might pass through plate 21 and have a threaded rear-end 31 secured with nut 29 at plate rear-side 23. As previously stated, peg trail-length 34, which is nearer to plate frontal-side 22 than is peg lead-length 35, is preferably of circular cross-section and does not exceeding ellipse minor-axis "NA" whereby a plurality of "shuriken" 90 might rotatably surround peg trail-length 34. However, peg lead-length 35 is cross-sectionally non-circular and its broadest-extent 36 is dimensionally intermediate ellipse axes "MA" and "NA". Accordingly, a "shuriken" 90 can be forwardly withdrawn from peg 30 only when the leadmost "shuriken" is counter-rotated about peg trail-length 34 until ellipse major-axis "MA" becomes parallel to lead-length broadest-extent 36.

Spring means (e.g. 50) are employed for the general purpose of preventing premature counter-rotation of the leadmost "shuriken" about axis 20A, by yieldably urging the plurality of "shuriken" against peg broadest-extent 36. At this condition, peg broadest-extent is preferably seated within the "shuriken" dual recesses "FG". Spring means embodiment 50 comprises a helical spring 51 surrounding peg 30 immediately forwardly of rack frontal-side 22 so as to yieldably urge the leadmost of "shurikens" 90 (which are rotatably surrounding peg trail-length 34) against peg lead-length 35. Spring means embodiment 50 additionally comprises a centrally open (57) upright washer 56 which is urged directly against the trailmost "shuriken" by helical spring 51. The cross-sectionally greatest-extent of washer central opening 57, which is preferably circular, is dimensionally less than peg broadest-extent 36 so that washer 56 does not slip off peg lead-length 35 after all "shurikens" are dispensed. To dispensably remove the leadmost "shuriken" 90, the operator presses it rearwardly toward plate frontal-side 22 (thereby compressing spring 51) whereupon said "shuriken" has its recesses "FG" away from peg lead-length 35, and then he counter-rotates the leadmost "shuriken" about peg trail-length 34 (as indicated by FIG. 5 curved arrow) until its major-axis "MA" becomes parallel to peg broadest-extent 36; thus, manual release of the leadmost "shuriken" causes it to slip off peg lead-length 35 and available for target throwing. Helical spring 51 51 might alternatively have its narrower end at plate frontal-side 22.

The rack member support means, which is employed for removably attaching the dispenser (e.g. 10) to the user's apparel at waistline level, might take a variety of forms. For example, a conventional safety-pin attached at plate rear-side 23 to permit affixing to clothing fabric, a downwardly extending clip for hanging from the waistline sash or belt, etc. In addition, for aesthetic and utilitarian reasons, the support means (e.g. 25–28) might enable the dispenser (10) to function as a buckle to join the terminii 101 and 102 of a waist belt. In this vein, sheet metal strip 25 can be pierced by peg threaded rear-end 31 and can be held against the plate rear-side 23 by nut 29. One side of strip 25 includes a rearwardly extending prong 26 to fit through a selected hole 103 of belt terminus 102. The other extension of strip 25 at 27 holds an annulus 28 for engaging the snap (101A) anchorable fold of the other belt terminus 101. Alternatively, the entire component 25 (including prong 26 and annulus 28) might be unitarily molded into rack plate 21. And such alternate rack plate might be centrally thick having a threaded hole for receiving peg threaded rear-end 31, thereby eliminating the need for a separate nut (29).

From the foregoing, the construction and operation of the waistline supportable dispensers for martial arts throwing stars will be readily understood and further explanation is believed to be unnecessary. However, since numerous modifications and changes will readily occur to those skilled in the art, it is not desired to limit the invention to the exact construction shown and described, and accordingly, other modifications and equivalents may be resorted to, falling within the scope of the appended claims.

What is claimed is as follows:

1. Waistline supportable dispenser for a plurality of uniplanar martial arts throwing stars, said throwing stars being respectively provided with an elliptical central opening, and said waistline supportable dispenser comprising:

a. a rack member having an upright frontal-side and having support means for removably attaching the rack member to the user's wearing apparel substantially at waistline level;

b. a horizontal peg rigidly attached to a central portion of the rack member and extending forwardly from its frontal-side, said peg including a trail-length relatively near said rack frontal-side and also including a cross-sectionally enlarged lead-length relatively forwardly remote from said frontal-side, said peg trail-length at its largest cross-sectional dimension being smaller than the minor-axis of the throwing star elliptical central opening, said peg lead-length being cross-sectionally ellipsoid wherein its broadest-extent is dimensionally intermediate the minor-axis and major-axis dimensions of the throwing star elliptical central opening;

c. a plurality of upright throwing stars rotatably surrounding the peg trail-length, the throwing stars being individually empirically rotated about said trail-length until their central opening minor-axes are parallel to the broadest-extent of the peg lead-length; and d. spring means extending forwardly from the rack member frontal-side so as to forwardly bear against the trailmost throwing star whereby the stars are yieldably urged against the peg lead-length in a condition wherein they can be individually dispensed commencing at the leadmost throwing star only by counter-rotation until the central opening major-axis becomes parallel to the broadest-extent of the peg lead-length.

2. The waistline supportable dispenser of claim 1 wherein the rack member comprises an upright circular plate having a rear-side and a planar upright frontal-side.

3. The dispenser of claim 2 wherein the support means extends rearwardly from the rack member rear-side and is adapted to attach the dispenser as a buckle to the user's belt apparel.

4. The dispenser of claim 3 wherein the spring means comprises a helical spring surrounding the peg trail-length and urging a centrally open washer against the trailmost throwing star, the cross-sectionally greatest-extent of said washer central opening being less than the broadest-exent of the peg ellipsoid lead-length.

5. The dispenser of claim 4 wherein each throwing star has a front-face and a geometrically similar rear-face, the front-face being dually recessed at the two positions where the central opening minor-axis meets the throwing star body whereby the peg ellipsoid lead-length might be seated within said dual recesses.

6. The waistline supportable dispenser of claim 1 wherein the spring means comprises a helical spring surrounding the peg trail-length and urges a centrally open washer against the trailmost throwing star, the cross-sectionally greatest-extent of said washer central opening being less than the broadest-extent of the peg wllipsoid lead-length.

7. The dispenser of claim 6 wherein each throwing star has a front-face and a geometrically similar rear-face, the front-face being dually recessed at the two positions where the central opening minor-axis meets the throwing star body whereby the peg ellipsoid lead-length might be seated within said dual recesses.

8. The waistline supportable dispenser of claim 1 wherein each throwing star has a front-face and a geometrically similar rear-face, the front-face being dually recessed at the two positions where the central opening minor-axis meets the throwing star body whereby the peg ellipsoid lead-length might be seated within said dual recesses.

* * * * *